US005195543A

United States Patent [19]

Berger

[11] Patent Number: 5,195,543

[45] Date of Patent: Mar. 23, 1993

[54] BALANCED FLOW TOBACCO SMOKE FILTER

[75] Inventor: Richard M. Berger, Midlothian, Va.

[73] Assignee: American Filtrona Corporation, Richmond, Va.

[21] Appl. No.: 783,345

[22] Filed: Oct. 28, 1991

[51] Int. Cl.[5] ..... A24D 1/04

[52] U.S. Cl. ..... 131/336; 131/339; 493/44; 493/45

[58] Field of Search ..... 131/336, 339, 331; 493/44, 45

[56] References Cited

U.S. PATENT DOCUMENTS

| | | |
|---|---|---|
| 3,297,041 | 1/1967 | Sproull et al. . |
| 3,533,416 | 10/1970 | Berger . |
| 3,552,400 | 1/1971 | Berger . |
| 3,599,646 | 8/1971 | Berger . |
| 3,637,447 | 1/1972 | Berger et al. . |
| 3,648,711 | 3/1972 | Berger et al. . |
| 3,805,801 | 4/1974 | Berger et al. . |
| 3,810,477 | 5/1974 | Berger et al. . |
| 3,811,451 | 5/1974 | Berger . |
| 4,022,221 | 5/1977 | Berger ..... 131/340 |
| 4,342,322 | 8/1982 | Sanford . |
| 4,343,319 | 8/1982 | Cantrell . |
| 4,362,171 | 12/1982 | Johnson et al. . |
| 4,380,241 | 8/1983 | Horsewell . |
| 4,438,776 | 3/1984 | Lamb et al. . |
| 4,506,683 | 3/1985 | Cantrell et al. . |
| 4,515,170 | 5/1985 | Cantrell et al. . |
| 4,547,253 | 10/1985 | Heaney et al. . |
| 4,580,584 | 4/1986 | Reynolds et al. . |
| 4,644,964 | 2/1987 | Duke . |
| 4,660,576 | 4/1987 | Horsewell . |
| 4,911,684 | 3/1990 | Duke et al. . |

*Primary Examiner*—Vincent Millin
*Assistant Examiner*—J. Doyle
*Attorney, Agent, or Firm*—Jacobson, Price, Holman & Stern

[57] ABSTRACT

A cigarette filter having a core of synthetic fibrous filter material and an outer plug wrap is provided with a group of longitudinal bores and a group of peripheral channels in the core to improve the filtration efficiency and to balance the distribution of smoke flow over the cross-sectional area of the filter.

16 Claims, 3 Drawing Sheets

BALANCED FLOW TOBACCO SMOKE FILTER

BACKGROUND OF THE INVENTION

This invention relates to tobacco smoke filter elements, more particularly for use as cigarette filters, although the products of the invention may also be useful as filters in other tobacco means, such as cigars, pipes and the like. Since filters for cigarettes are particularly commercially important, the basic embodiments of the invention will be discussed as they relate to filter tip cigarettes.

The prior art is replete with proposals for improved cigarette filters made both from natural products, particularly paper, or synthetic fiber products such as cellulose acetate. An important property of a tobacco smoke filter is its efficiency, that is its ability to remove undesirable constituents from tobacco smoke. Filtration efficiency is generally measured in terms of the percentage of total particulate matter (TPM) removed from the smoke. While filtration efficiency is perhaps the most important property of cigarette filters, other properties must also be considered including pressure drop, taste, hardness, appearance and cost. It is necessary to produce a filter which satisfies commercial requirements in each of these areas.

Frequently, it is necessary to compromise certain properties in order to satisfy the need of others. For example, commonly utilized cellulose acetate filters have a relatively low filtration efficiency since increased efficiency can only be obtained, either by increasing the density of the filter material or the length of the filter element, both of which steps produce a pressure drop across the filter which is excessive and unacceptable from a commercial or consumer standpoint. While various suggestions have been made for the production of filters having improved filtering properties, a considerable number of prior art developments have not been commercially acceptable, either because the resulting filter has been found to have objectionable "taste" characteristics, whereby cigarettes provided with such filters fail to satisfy a large segment of the smoking public, or because the techniques and/or the materials utilized in the production of such filters have increased the cost excessively.

High filtration efficiency has been considered by the industry to be removal of at least 60% of total particulate matter. Cigarette filters having such properties are disclosed, for example, in prior U.S. Pat. Nos. 3,533,416, 3,599,646, 3,637,447, 3,648,711, 3,805,801 3,810,477, 3,811,451 and 3,847,064 all of which are commonly assigned with the instant application. The disclosures of the prior patents are incorporated herein in their entirety by reference.

One particular form of high filtration efficiency cigarette filter which has achieved considerable commercial success is disclosed, for example, in U.S. Pat. No. 4,022,221 which is also commonly assigned herewith and incorporated herein by reference. Broadly stated, cigarette filters in accordance with U.S. Pat. No. 4,022,221 have an inner fibrous cylindrical filter member bonded to a tubular outer member (generally a plug wrap), and the inner member includes both an axially extending elongate central cavity as well as a series of circumferentially spaced outer cavities or channels with the general purpose of improving the flow path of tobacco smoke through the filter and enabling greater utility of the filtering material from which it is made.

The patent also discloses methods and means for producing such filters. While filters of the above type are successful in obtaining a high filtration efficiency combined with an acceptable pressure drop, due to the presence of the central cavity in such filters, the harsher smoke tends to be channeled down the center.

It is considered by certain cigarette manufactures that the resistance to flow of smoke should be higher in the center of the filter than at the filter periphery in order to provide improved taste. Standard filters, even those without a central cavity, tend to have a lower flow resistance in the center than at the periphery, because the fibrous material from which the filter is made is frequently compressed, and becomes slightly more dense on the outside of the filter than in the center of the filter.

Other known filters have a higher resistance to flow in the center of the filter, achieved, for example, by inserting plugs or tubes in the central cavity or by varying the density of the fiber mass over the cross-section of the filter with higher fiber densities being provided at the filter axis. Examples of such further filters are disclosed in U.S. Pat. Nos. 4,026,306, 4,046,063 and 4,064,791, all of which are commonly assigned herewith and also incorporated in their entirety by reference. While such filters may provide higher resistance to draw in the center of the filter, some harshness in taste remains.

In the late 1970's the trend in the tobacco industry was for high filtration filters producing smoke with a low tar content. In the early 1980's air dilution was used to achieve low tar content without filtration, but this resulted in cigarettes with little taste. There is now a demand for filters having high filtration with little or no air dilution and with the filter preferably having a conventional end appearance. Also, to improve the taste characteristics, there is a demand for a filter having more balanced filtration over the cross-section of the filter. Since conventional cellulose acetate, which is commercially available has a relatively large fiber size, there is no known filter design to achieve the desired filtration levels consistent with the other filter requirements. Certain manufacturers have reverted to paper-type filters which offer smaller fibers and improved filtration, but the problem with this type of filter is that the end appearance may not be acceptable to smokers. Composite filters which overcome this problem are generally not cost effective.

SUMMARY OF THE INVENTION

It is a general object of the invention to provide a tobacco smoke filter of synthetic fibrous material, such as cellulose acetate, which has high filtration efficiency of the order of paper and other sheet or fine fiber filters, but which can be formed to provide a conventional end appearance free of apertures. Such an object is achieved by providing the filter with an arrangement of elongate cavities for balancing the flow of tobacco smoke over the entire cross-sectional area of the filter, thereby improving the uniformity of flow, providing better filtration efficiency, and generally improving the tobacco smoke taste.

In accordance with the invention, therefore, there is provided a tobacco smoke filter having an elongate cylindrical inner member of fibrous material bonded to a tubular outer member, such as a conventional plug wrap. The inner member is formed with a plurality (preferably 3 to 5) of relatively small diameter, longitudinally extending bores which are arranged symmetrically around the center line or axis of the filter, and which preferably extend from one end of the filter, generally the end which contacts the tobacco rod of a cigarette, to a location which is spaced from the opposite or outer end of the filter. Additionally, the inner member of the filter is provided with a plurality, conveniently 8, equally circumferentially spaced elongate channels around its outer circumference, the bores and channels being overlapped to an extent lengthwise of the filter, and the channels also terminating at a location which is spaced from the outer or mouthpiece end of the filter.

By the above arrangement, the filter is provided with a plain conventional outer end free of apertures, while the arrangement and disposition of the bores and channels is highly effective in distributing the smoke flow throughout the cross-sectional area of the filter thereby lowering pressure drop, improving filtration efficiency, and distributing smoke flow away from the center of the filter to result in improved taste characteristics.

In one preferred form of the filter according to the invention, the channels are inclined relative to the filter axis to minimize the possibility of the channels becoming clogged with material of the outer plug wrap.

Filters according to the invention, and continuous filter rods from which they are cut, may be manufactured by well-known techniques, for example, of the type referred to in U.S. Pat. No. 4,022,221, modified by using a multi-prong reciprocatory mandrel for producing the bores, rather than a solid mandrel of the type disclosed in said patent which produces a single central cavity.

Additional features and advantages of the invention will become apparent from the ensuing description and claims read in conjunction with the attached drawings.

DESCRIPTION OF PREFERRED EMBODIMENTS

Figure 1:
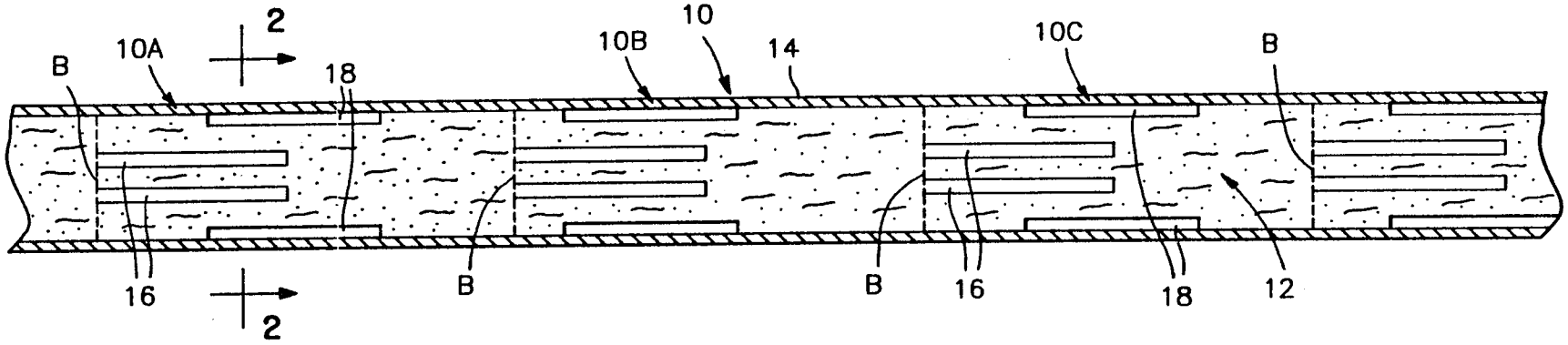
FIG. 1 is a longitudinal cross-sectional view of a continuous filter rod for producing cigarette filters in accordance with the present invention.
Figure 2:
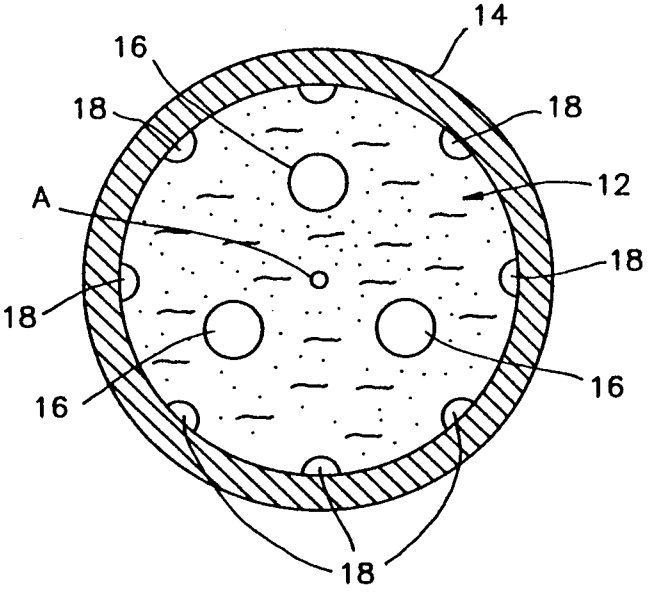
FIG. 2 is a sectional view on line 2—2 of FIG. 1.

Referring initially to FIGS. 1 and 2, there is shown therein a continuous filter rod 10 from which individual tobacco smoke filters such as filters 10A, 10B and 10C may be cut for use on individual cigarettes. The rod 10 has a cylindrical inner member or core 12 of filter material of a kind well-known in the art, the core being wrapped or bonded to a tubular outer member 14, such as a conventional plug wrap. The core material conveniently is made from a high density cellulose acetate low DPF tow although other filtering materials may be used with slight modifications. For example, filamentary tow formed of other materials such as polyethylene, polypropylene and the like or even nonwoven staple fibers of the type described in some detail in U.S. Pat. Nos. 3,297,041 and 3,552,400, also commonly assigned and incorporated by reference may also be used.

As shown in the illustrated preferred embodiment, at regular intervals along the length of the filter rod, the core 12 is provided with a group of three longitudinally extending bores 16 which, as shown in FIG. 2, are symmetrically, preferably equally, disposed around the central axis A of the filter rod, i.e., in the case of three longitudinal bores 16, the axes of the respective bores will be displaced by 120°.

Figure 5:
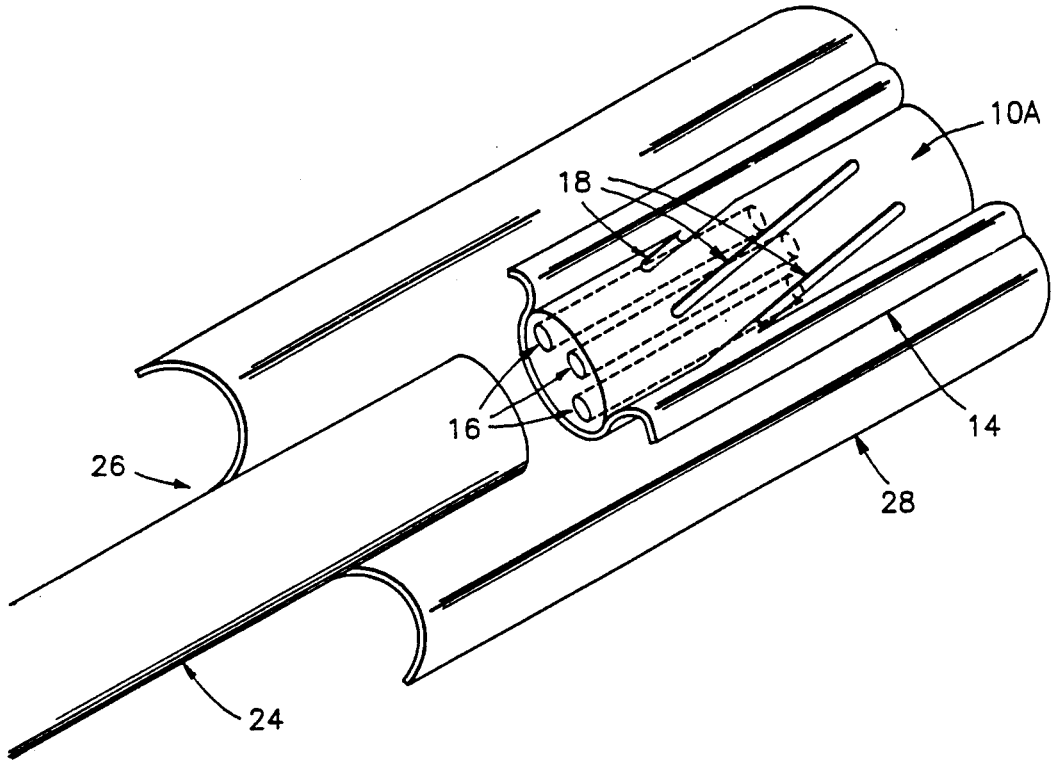
FIG. 5 is an exploded perspective view of a cigarette and cigarette filter according to the invention.

Also, at regular intervals along the rod, the core is provided with groups of elongate, circumferentially spaced channels 18 (conveniently 8 in number) which are symmetrically, preferably equally, circumferentially spaced around the periphery of the core, in a manner whereby they do not interfere with the bonding of the outer member 14 in areas circumferentially between the channels and in the lengthwise sections between the ends of the channels. It will be noted that each group of channels 18 overlaps longitudinally at one end with a respective group of bores 16, but that there is an interval between the other end of the group of channels and the next group of bores in which the core material is substantially continuous and free of any apertures. As shown in FIG. 5, but not evident in FIGS. 1 and 2, the channels 18 are preferably formed on an incline relative to the axis A of the filter rod in order to minimize clogging by the material of the plug wrap 14.

Figure 3:
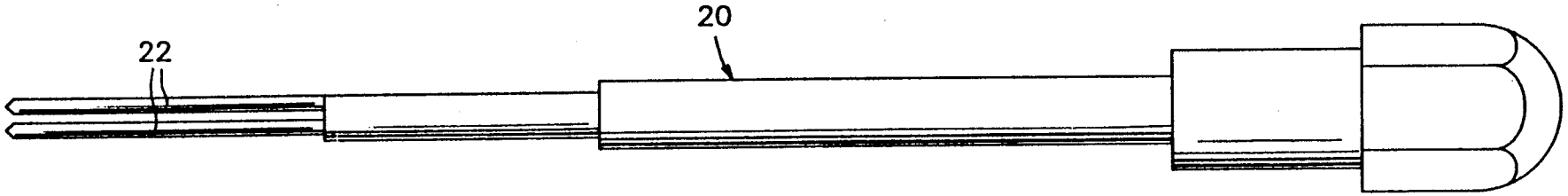
FIG. 3 is a longitudinal view of a mandrel used in apparatus for producing the filter rod.
Figure 4:
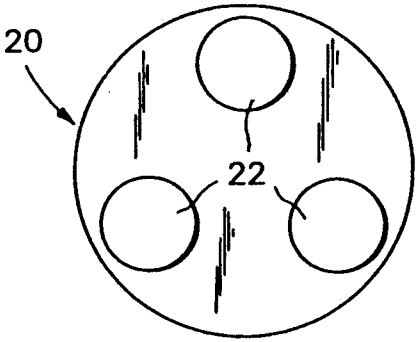
FIG. 4 is a enlarged end view of the mandrel.

The filter rod shown in FIGS. 1 and 2 may conveniently be manufactured by well-known methods and apparatus of the kind, for example, disclosed in the aforenoted U.S. Pat. Nos. 4,022,221 and 3,847,064. Such methods and means include, inter alia, a reciprocatory mandrel for producing intermittently the longitudinally spaced groups of internal cavities or bores in the core material and cam wheels for intermittently producing the spaced groups of channels on the exterior of the core material. While the methods and apparatus disclosed in said patents may generally be used for producing the filter rod 10, a modified reciprocatory mandrel, such as mandrel 20 shown in FIGS. 3 and 4 is required for producing the respective groups of bores 16. Thus, for manufacturing the preferred filter product, the mandrel 20 has three suitably located pins 22 for forming the respective bores rather than a single enlarged mandrel element for making a single central cavity as in the aforenoted patents. In other respects, the method and apparatus for manufacturing the filter rod 10 conforms with the method and apparatus of the above noted patents. In respect of the mandrel 20, it may be noted that the pins 22 are somewhat larger in diameter than the ultimate diameter of bores 16 due to a shrinkage effect of the core material when the mandrel is withdrawn.

Figure 6:
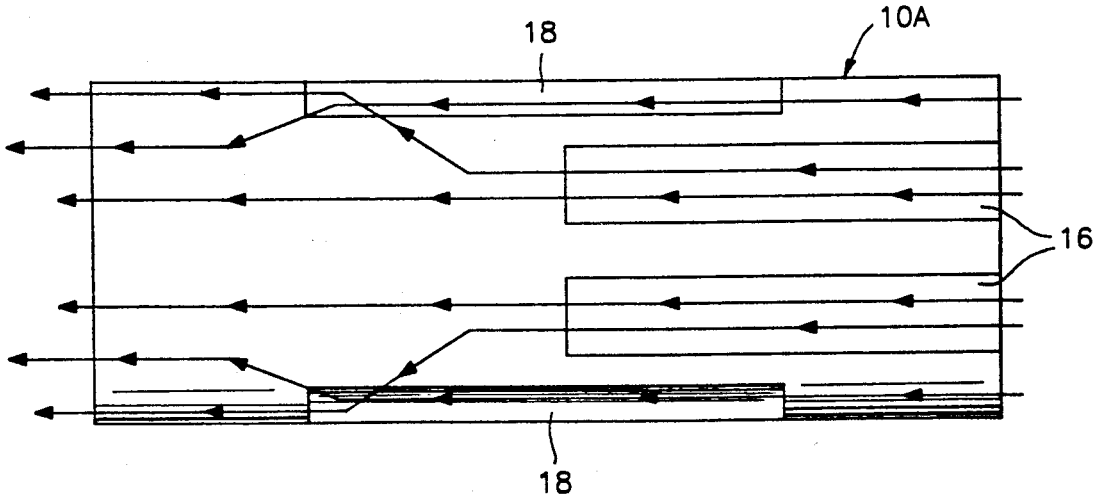
FIG. 6 is a somewhat diagrammatic longitudinal sectional view through a filter as shown in FIG. 5 illustrating the flow of smoke through the filter.

To form the filter rod 10 into individual cigarette filters, the rod is cut at the dotted lines B in FIG. 1, located substantially at the forward ends of each group of bores 16. The effect of the cuts B is to produce individual filters as shown in FIGS. 5 and 6. Thus, it will be evident that, in each filter (filter 10A being shown as illustrative in FIGS. 5 and 6,) the bores 16 extend lengthwise into the filter from one end thereof, which end preferably in use is positioned adjacent the tobacco rod 24 of a cigarette 26, while the other or outer end of the filter 10A is of conventional form and free of any apertures, channels and the like. While it is preferred to dispose the filter with the bores 16 opening onto the tobacco rod, so as to obtain an aperture-free outer end, for appearance purposes, it is believed that the filter may be reversed and still operate in a similar manner. FIG. 5 shows the filter 10A and tobacco rod 24 being combined to form a cigarette by conventional tipping paper 28.

FIG. 6 shows, by way of arrowed lines, the path of tobacco smoke flow through the filter and vividly illustrates the balancing effect of the bores 16 and channels 18 in distributing the flow across the entire cross-sectional area of the filter. As shown in FIG. 6, the grooves 18 may be centrally disposed lengthwise of the filter.

Preferably, in each individual filter, the group of bores 16 and the group of channels 18 should contribute equally to the pressure drop loss across the filter compared to a plain filter absent any bores and channels. In modifying a plain straight filter having a pressure drop of 9 inches of water to produce a filter according to the invention having an overall pressure drop of three inches of water, the group of bores 16 and the group of channels 18 should each provide a pressure drop reduction of 3 inches of water, for optimum smoke flow balance.

A filter structure according to the invention may operate successfully with conventional density filter rods because the distribution of the bores and channels can be spaced to achieve uneven resistance to smoke through all sections of the filter by placement of the bores away from the filter axis. Accordingly, the filter will have a higher pressure drop across the central section thereof.

Typical dimensions for the bores and channels in a filter having a 21 mm length and a 24 to 24.5 mm circumference may be as follows: Bores 1.56 mm diameter and 11 mm long (produced by mandrel prongs 1.9 mm diameter and 11 mm long), channels 1.02 mm wide, 0.51 mm deep and 12 mm long (produced by cam wheel grooves 1.61 mm wide, 0.89 mm deep and 13 mm long). These dimensions produce an overall bore volume per group of 0.063 cc and an overall channel volume per group of 0.050 cc.

By way of example, the following table illustrates the improved filtering effect obtained by filters according to the present invention having the above dimensions, compared with previously known filters. In this table, Type A represents a filter according to the present invention, whereas Types B and C represent filters according to the prior art techniques.

| Type | Wt Grams/ Tip | Tip PD ("$H_2O$) | Tip Length | Retention % |
|---|---|---|---|---|
| A | 0.25 | 2.8" | 21 mm | 70 |
| B | 0.41 | 2.8" | 25 mm | 69 |
| C | 0.41 | 2.8" | 25 mm | 69 |

It will be evident from the above that the filter according to the invention obtains similar retention efficiency to the known filters using a shorter length of filter, namely 21 mm compared with 25 mm, representing an approximate 40% saving in filter weight. It should be noted that, when comparing filters of different lengths, you can expect a 4% increase in filtration between a 21 mm and 25 mm tip at the same pressure drop. Thus, the 70% filtration shown above would increase to 74% on a 25 mm tip. Therefore, for an equivalent length filter, the filtration efficiency may be increased by approximately 5% using a filter according to the invention. As previously noted, the subject filters also improve the taste characteristics by improving the flow distribution over the filter cross-section.

While only preferred embodiments of the invention have been described herein in detail, the invention is not limited thereby and modifications can be made within the scope of the attached claims.

I claim:

1. A filter rod to be cut into individual tobacco smoke filters comprising an elongate cylindrical core of fibrous filter material and an outer tubular member encasing the core, the core including first portions defining longitudinally spaced groups of lengthwise extending bores formed through the fibrous material, and second portions defining longitudinally spaced groups of lengthwise extending channels formed around the periphery of the fibrous material within the tubular member, the bores of each group being substantially symmetrically disposed relative to a longitudinal axis of the rod, the channels of each group being substantially symmetrically spaced around the periphery of the fibrous material, each group of bores and each group of channels having leading and trailing end portions, respectively, the leading end portions of each group of channels overlapping lengthwise with the trailing end portions of a respective group of bores, and the trailing end portions of each group of channels being spaced from the leading end portions of a succeeding group of bores, to define between said trailing end portions of each group of channels and said leading end portions of the succeeding group of bores, a lengthwise section of the core which is free of said bores and channels.

2. A filter rod as defined in claim 1, wherein the bores of each group are each spaced from said axis.

3. A filter rod as defined in claim 1, wherein the bores of each group number at least three.

4. A filter rod as defined in claim 1, wherein the bores in each group number between three and five.

5. A filter rod as defined in claim 1, wherein the channels in each group of channels are inclined with respect to said axis.

6. A filter rod as defined in claim 1 cut transversely at the leading end of each group of bores to form individual filters each having one end from which the bores extend into the filter and an opposite plain end free of the bores and channels.

7. A tobacco smoke filter comprising a cylindrical core of fibrous filter material and an outer tubular member encasing the core, portions of the core defining a plurality of elongate bores symmetrically located relative to a longitudinal axis of the filter, extending into the core from one end of the filter and terminating at a location spaced from an opposite end of the filter, and further portions of the core defining a plurality of elongated channels substantially symmetrically spaced around an outer surface of the core within the tubular member, the channels having opposite ends which are spaced from respective ends of the filter.

8. A filter as defined in claim 7, wherein the bores and channels overlap lengthwise.

9. A filter as defined in claim 7, wherein the channels are substantially centrally located lengthwise of the filter.

10. A filter as defined in claim 7, wherein the channels are inclined relative to said axis.

11. A filter as defined in claim 7, wherein each bore is spaced from said axis.

12. A filter as defined in claim 7, wherein the bores number at least three.

13. A filter as defined in claim 7, wherein the bores number from three to five.

14. A filter as defined in claim 7, wherein the bores as a group and the channels as a group are configured and dimensioned for contributing equally to a decrease in flow resistance across the filter.

15. A filter as defined in claim 7 in combination with a tobacco rod and a tipping wrap to form a cigarette.

16. A filter as defined in claim 15, wherein said one end of the filter is positioned adjacent the tobacco rod.

* * * * *